US010774652B2

(12) United States Patent
S et al.

(10) Patent No.: US 10,774,652 B2
(45) Date of Patent: Sep. 15, 2020

(54) AIRFOIL SHAPE FOR A COMPRESSOR

(71) Applicant: General Electric Comapny, Schenectady, NY (US)

(72) Inventors: Vasantharuban S, Bangalore (IN); Prem Navin Dhayanandam, Bangalore (IN); Lakshmanan Valliappan, Bangalore (IN)

(73) Assignee: General Electric Company, Schenectady, NY (US)

( * ) Notice: Subject to any disclaimer, the term of this patent is extended or adjusted under 35 U.S.C. 154(b) by 20 days.

(21) Appl. No.: 16/107,185

(22) Filed: Aug. 21, 2018

(65) Prior Publication Data

US 2019/0063228 A1 Feb. 28, 2019

(30) Foreign Application Priority Data

Aug. 30, 2017 (IN) ..... 201741030642

(51) Int. Cl.
*F01D 5/14* (2006.01)
*F01D 9/04* (2006.01)

(52) U.S. Cl.
CPC ..... *F01D 5/141* (2013.01); *F01D 9/041* (2013.01); *F05D 2240/12* (2013.01); *F05D 2240/301* (2013.01); *F05D 2240/305* (2013.01); *F05D 2240/306* (2013.01); *F05D 2250/74* (2013.01)

(58) Field of Classification Search
CPC .... F04D 29/324; F04D 29/384; F04D 29/544; F01D 5/141; F01D 9/02; F01D 9/041; F05D 2250/74; F05D 2240/12; F05D 2240/123; F05B 2240/12; F05B 2240/30
See application file for complete search history.

(56) References Cited

U.S. PATENT DOCUMENTS 9,145,777 B2 * 9/2015 Dutka ..... F01D 5/3038
9,175,693 B2 * 11/2015 Dutka ..... F04D 29/324

* cited by examiner

*Primary Examiner* — Igor Kershteyn
*Assistant Examiner* — Andrew Thanh Bui
(74) *Attorney, Agent, or Firm* — Charlotte C. Wilson; James W. Pemrick

(57) ABSTRACT

An article of manufacture having a nominal airfoil profile substantially in accordance with Cartesian coordinate values of X, Y, and Z set forth in a scalable table identified as TABLE 1, wherein the Cartesian coordinate values of X, Y, and Z are non-dimensional values convertible to dimensional distances by multiplying the Cartesian coordinate values of X, Y, and Z by a number, and wherein X and Y are coordinates which, when connected by continuing arcs, define airfoil profile sections at each Z height, the airfoil profile sections at each Z height being joined with one another to form a complete airfoil shape. The resulting article may be used as a stator vane in a compressor.

20 Claims, 3 Drawing Sheets

AIRFOIL SHAPE FOR A COMPRESSOR

BACKGROUND

The present disclosure relates generally to an airfoil for use in turbomachinery, and more particularly relates to an airfoil profile or airfoil shape for use in a compressor.

In turbomachines, many system requirements should be met at each stage of the turbomachine's flow path to meet design goals. These design goals include, but are not limited to, overall improved efficiency, reduction of vibratory response and improved airfoil loading capability. For example, a compressor airfoil profile should achieve thermal and mechanical operating requirements for a particular stage in the compressor. Moreover, component lifetime, reliability and cost targets also should be met.

SUMMARY

According to one aspect of the present disclosure, an article of manufacture is provided having a nominal airfoil profile substantially in accordance with Cartesian coordinate values of X, Y, and Z set forth in a scalable table identified herein as TABLE 1, wherein the Cartesian coordinate values of X, Y, and Z are non-dimensional values convertible to dimensional distances by multiplying the Cartesian coordinate values of X, Y, and Z by a number, and wherein X and Y are coordinates which, when connected by continuing arcs, define airfoil profile sections at each Z height, the airfoil profile sections at each Z height being joined smoothly with one another to form a complete airfoil shape.

According to another aspect of the present disclosure, an article of manufacture is provided having a suction-side nominal airfoil profile substantially in accordance with suction-side Cartesian coordinate values of X, Y, and Z set forth in a scalable table identified herein as TABLE 1, wherein the Cartesian coordinate values of X, Y, and Z are non-dimensional values convertible to dimensional distances by multiplying the Cartesian coordinate values of X, Y, and Z by a number, and wherein X and Y are coordinates which, when connected by continuing arcs, define airfoil profile sections at each Z height, the airfoil profile sections at each Z height being joined smoothly with one another to form a complete suction-side airfoil shape, the X, Y, and Z coordinate values being scalable as a function of the number to provide at least one of a non-scaled, scaled-up, and scaled-down airfoil profile.

According to yet another aspect of the present disclosure, a compressor is provided comprising a plurality of stator vanes, each of the stator vanes including an airfoil having a suction-side airfoil shape, the airfoil having a nominal profile substantially in accordance with suction-side Cartesian coordinate values of X, Y, and Z set forth in a scalable table identified herein as TABLE 1, wherein the Cartesian coordinate values of X, Y, and Z are non-dimensional values convertible to dimensional distances by multiplying the Cartesian coordinate values of X, Y, and Z by a number, and wherein X and Y are coordinates which, when connected by continuing arcs, define airfoil profile sections at each Z height, the airfoil profile sections at each Z height being joined smoothly with one another to form a complete suction-side airfoil shape.

These and other features and improvements of the present disclosure should become apparent to one of ordinary skill in the art upon review of the following detailed description when taken in conjunction with the several drawings and the appended claims.

DETAILED DESCRIPTION

One or more specific aspects/embodiments of the present compressor stator vane will be described below. In an effort to provide a concise description of these aspects/embodiments, all features of an actual implementation may not be described in the specification. It should be appreciated that in the development of any such actual implementation, as in any engineering or design project, numerous implementation-specific decisions must be made to achieve the developers' specific goals, such as compliance with machine-related, system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments of the presently claimed subject matter, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "one aspect" or "an embodiment" or "an aspect" of the present disclosure are not intended to be interpreted as excluding the existence of additional embodiments or aspects that also incorporate the recited features. Turbomachinery is defined as one or more machines that transfer energy between a rotor and a fluid or vice-versa, including but not limited to gas turbines, steam turbines, and compressors.

Figure 1:
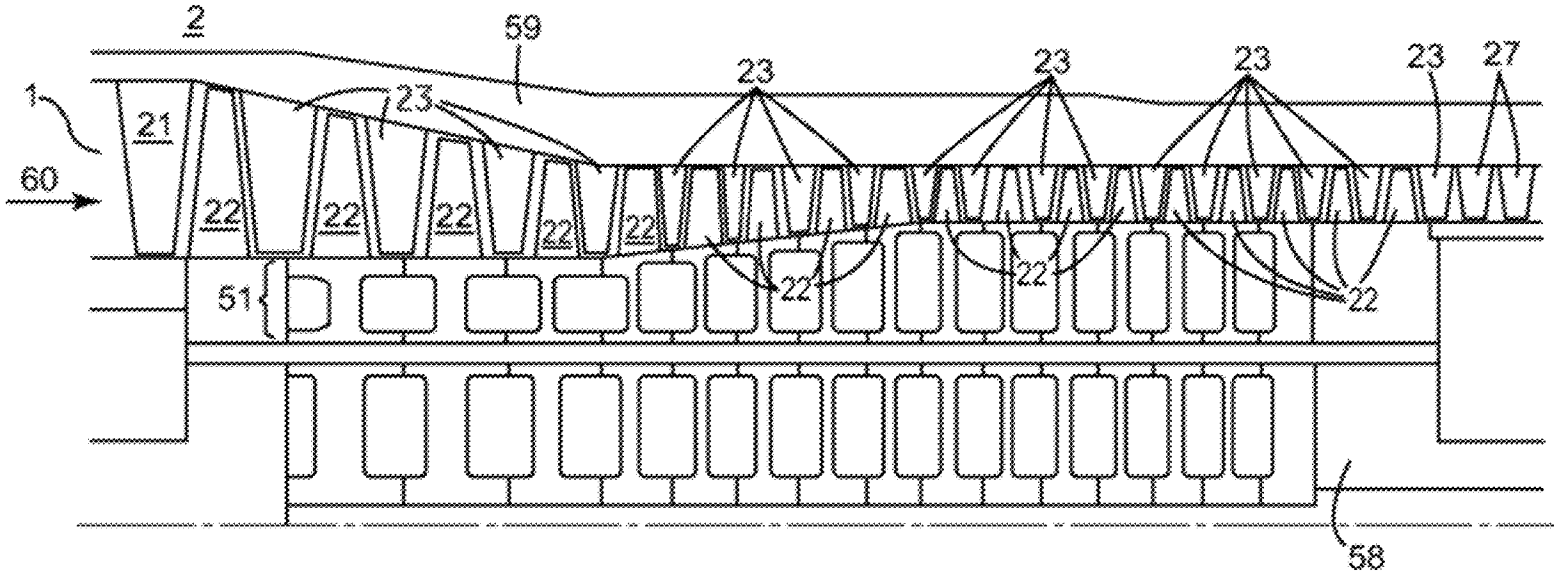
FIG. 1 is a schematic representation of a compressor flow path through multiple stages and illustrates exemplary compressor stages, according to an aspect of the disclosure.

Referring now to the drawings, FIG. 1 illustrates an axial compressor 2 that may be used in conjunction with, or as part of, a gas turbine. The compressor 2 includes a plurality of compressor stages. A set of rotating (or rotor) blades and an adjacent set of stationary (or stator) vanes define a compressor stage. Commonly, the stator vanes of a particular stage are downstream of the rotor blades. However, in some designs, the stator vanes may precede the rotor blades. Rotor blades 22 are attached to a rotor or other rotating component within the compressor 2, while the stator vanes 23 are attached to a stationary casing. It is to be understood that any number of rotor and stator stages can be provided in the compressor, as described herein.

The compressor 2 defines a flow path 1 for fluids (e.g., air) being compressed therein, which may include from fourteen to eighteen rotor/stator stages. However, the exact number of rotor and stator stages is a choice of engineering design, and may be more or less than the eighteen stages illustrated in FIG. 1. The eighteen stages are merely exemplary of one turbine/compressor design, and are not intended to limit the presently claimed compressor stator vane in any manner.

The compressor rotor blades 22 impart kinetic energy to the airflow by accelerating the airflow, and the stator vanes 23 convert the increased rotational kinetic energy into static pressure, bringing about a desired pressure rise. Both the rotor blades 22 and stator vanes 23 turn the airflow, slow the airflow velocity (in the respective airfoil frame of reference), and yield a rise in the static pressure of the airflow. Typically, in axial flow compressors, multiple stages of rotor/stator sets are arranged to achieve a desired discharge-to-inlet pressure ratio.

Each rotor blade 22 and stator vane 23 includes an airfoil, and these airfoils can be secured to rotor wheels or a stator case by an appropriate attachment configuration, often known as a "root," "base," or "dovetail" (not shown). In addition, compressors may also include inlet guide vanes (IGVs) 21 and exit or exhaust guide vanes (EGVs) 27. All of these blades and vanes have airfoils that act on the medium (e.g., air) passing through the compressor flow path 1.

Exemplary stages of the compressor 2 are illustrated in FIG. 1. One stage of the compressor 2 comprises a plurality of circumferentially spaced rotor blades 22 mounted on a rotor wheel 51 and a plurality of circumferentially spaced stator vanes 23 attached to a static compressor case 59. Each of the rotor wheels 51 may be attached to an aft drive shaft 58, which may be connected to the turbine section of the engine. The rotor blades 22 and stator vanes 23 lie in the flow path 1 of the compressor 2. The direction of airflow through the compressor flow path 1, as described herein, is indicated by the arrow 60 (FIG. 1), and flows generally from left to right in the illustration. The rotor blades and stator vanes herein of the compressor 2 are merely exemplary of the stages of the compressor 2 within the scope of the present disclosure. In addition, each inlet guide vane 21, rotor blade 22, stator vane 23, and exit guide vane 27 may be considered an article of manufacture. Further, the article of manufacture described herein may be a stator vane configured for use with the compressor 2.

Figure 2:
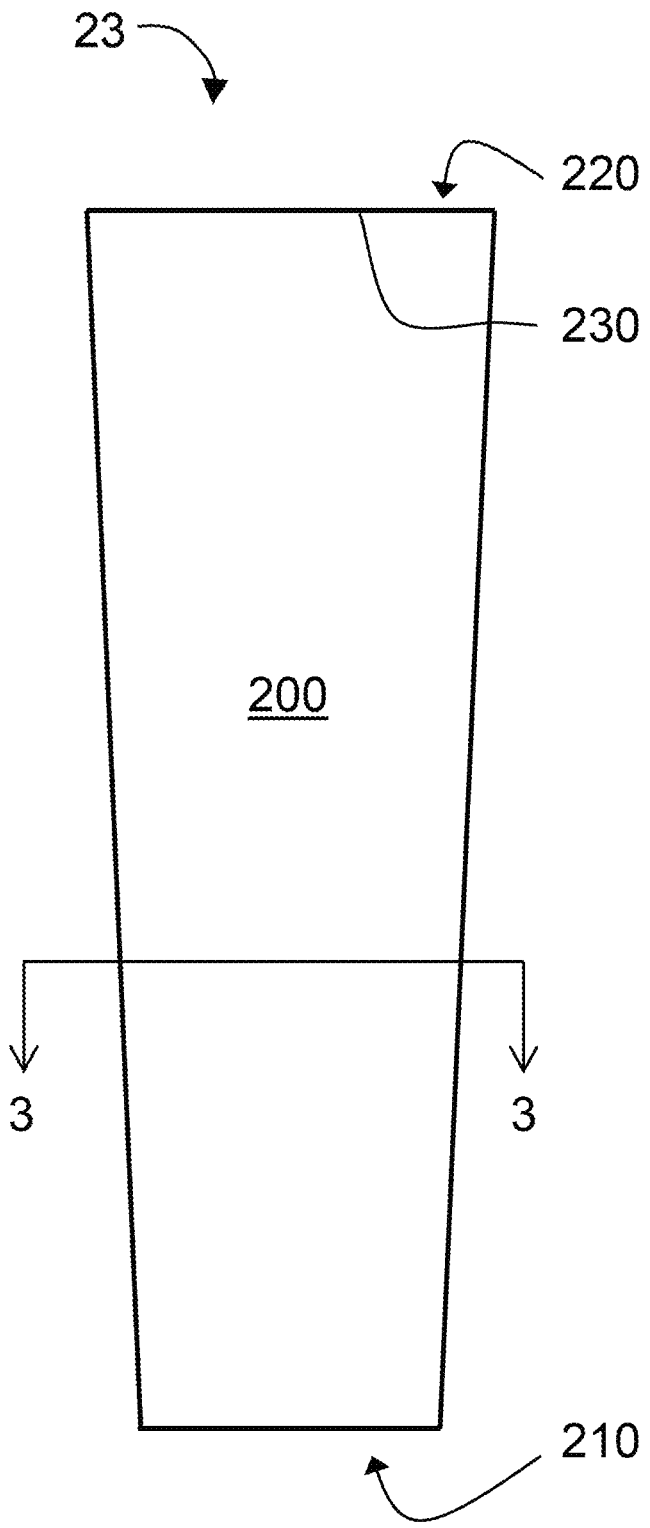
FIG. 2 is a perspective view of a stator vane, according to an aspect of the disclosure.
Figure 3:
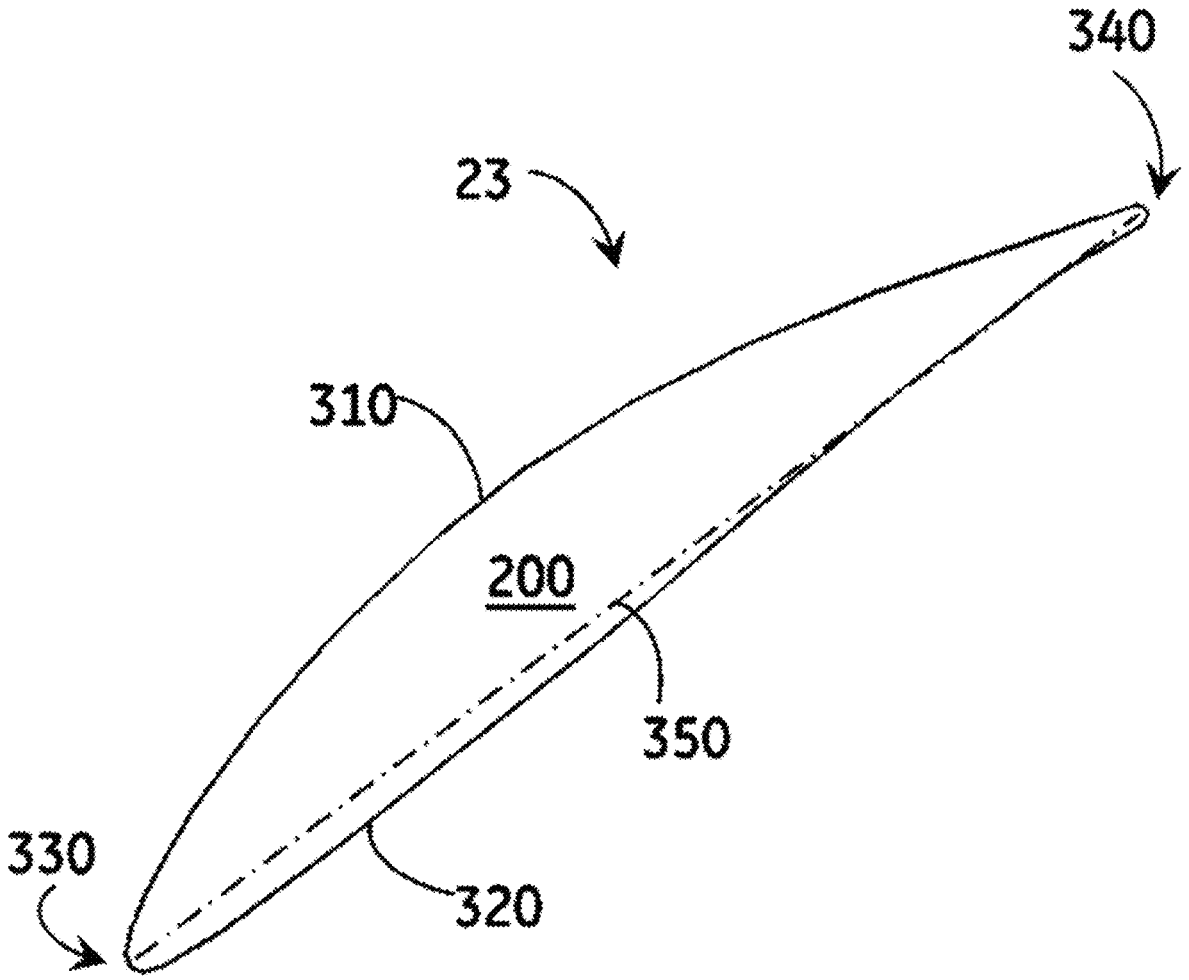
FIG. 3 is a cross-sectional view of the stator vane airfoil taken generally about on line 3-3 in FIG. 2, according to an aspect of the present disclosure.

A stator vane 23, illustrated in FIG. 2, is provided with an airfoil 200. Each of the stator vanes 23 has an airfoil profile at any cross-section from the airfoil root 220 to the airfoil tip 210. Referring to FIG. 3, it will be appreciated that each stator vane 23 has an airfoil 200 as illustrated. The airfoil 200 has a suction side 310 and a pressure side 320. The suction side 310 is located on the opposing side of the airfoil from the pressure side 320. Thus, each of the stator vanes 23 has an airfoil profile at any cross-section in the shape of the airfoil 200. The airfoil 200 also includes a leading edge 330 and a trailing edge 340, and a chord length 350 extends there between. The root of the airfoil corresponds to the lowest non-dimensional Z value of scalable TABLE 1. The tip of the airfoil corresponds to the highest non-dimensional Z value of scalable TABLE 1.

An airfoil may extend beyond the compressor flowpath and may be tipped to achieve the desired endwall clearances. As non-limiting examples only, the height of the airfoil 200 may be from about 1 inch to about 30 inches or more, about 5 inches to about 20 inches, about 5 inches to about 15 inches, or about 10 inches to about 15 inches. However, any specific airfoil height may be used as desired in the specific application. As will be appreciated, longer airfoils 200 may be used in the initial stages, while airfoils of progressively shorter lengths may be used in the subsequent stages.

The compressor flow path 1 requires airfoils that meet system requirements of aerodynamic and mechanical blade/vane loading and efficiency. For example, it is desirable that the airfoils are designed to reduce the vibratory response or vibratory stress response of the respective blades and/or vanes. Materials such as high strength alloys, non-corrosive alloys and/or stainless steels may be used in the blades and/or vanes.

To define the airfoil shape of each blade airfoil and/or vane airfoil, there is a unique set or loci of points in space that meet the stage requirements and that can be manufactured. These unique loci of points meet the requirements for stage efficiency and are arrived at by iteration between aerodynamic and mechanical loadings, thus enabling the turbine and compressor to run in an efficient, safe, reliable and smooth manner. These points are unique and specific to the system. The loci that define the airfoil profile include a set of points with X, Y, and Z coordinates relative to a reference origin coordinate system.

The three-dimensional Cartesian coordinate system of X, Y, and Z values given in scalable TABLE 1 below defines the profile of the stator vane airfoil at various locations along its length. Scalable TABLE 1 provides data for a non-coated airfoil. The envelope/tolerance for the coordinates is about +/−5% of the chord length 350 in a direction normal to any airfoil surface location, or about +/−0.25 inches in a direction normal to any airfoil surface location. However, tolerances of about +/−0.15 inches to about +/−0.25 inches, or about +/−3% to about +/−5% in a direction normal to an airfoil surface location may also be used, as desired in the specific application.

The point data origin 230 may be the mid-point of the suction side of the base of the airfoil, the pressure side of the base of the airfoil, the leading edge of the base of the airfoil, the trailing edge of the base of the airfoil, or any other suitable location as desired. The coordinate values for the X, Y, and Z coordinates are set forth in non-dimensionalized units in scalable TABLE 1, although other units of dimensions may be used when the values are appropriately converted. As one example only, the Cartesian coordinate values of X, Y, and Z may be convertible to dimensional distances by multiplying the X, Y, and Z values by a multiplying by a constant number (e.g., 100). The number, used to convert the non-dimensional values to dimensional distances, may be a fraction (e.g., ½, ¼, etc.), decimal fraction (e.g., 0.5, 1.5, 10.25, etc.), integer (e.g., 1, 2, 10, 100, etc.) or a mixed number (e.g., 1½, 10¼, etc.). The dimensional distances may be any suitable unit of measure (e.g., inches, feet, millimeters, centimeters, meters, etc.). As one non-limiting example only, the Cartesian coordinate system has orthogonally-related X, Y, and Z axes, in which the X axis may lie generally parallel to the compressor rotor centerline (i.e., the rotary axis) and a positive X coordinate value is axial toward the aft (i.e., exhaust end) of the turbine. The positive Y coordinate value extends tangentially in the direction of rotation of the rotor, and the positive Z coordinate value is radially outwardly toward the rotor blade tip, stator vane or stator vane base. All the values in scalable TABLE 1 are based on measurements at room temperature and are unfilleted.

By defining X and Y coordinate values at selected locations in a Z direction (or height) normal to the X, Y plane, the profile section or airfoil shape of the airfoil at each Z height along the length of the airfoil can be ascertained. By connecting the X and Y values with smooth continuing arcs, each profile section at each Z height is fixed. The airfoil profiles of the various surface locations between each Z height are determined by smoothly connecting the adjacent profile sections to one another to form the airfoil profile.

The TABLE 1 values are generated and shown from zero to four or more decimal places for determining the profile of the airfoil. As the airfoil heats up during use, the associated stress and temperature will cause a change in the X, Y, and Z values. Accordingly, the values for the profile given in TABLE 1 represent ambient, non-operating, or non-hot conditions (e.g., room temperature). As mentioned above, the values in TABLE 1 define a profile of an uncoated airfoil.

There are typical manufacturing tolerances as well as optional coatings which must be accounted for in the actual profile of the airfoil. Each section is joined smoothly with the other sections to form the complete airfoil shape. It will therefore be appreciated that +/−typical manufacturing tolerances, i.e., +/−values, including any coating thicknesses, are additive to the X and Y values given in TABLE 1 below. Accordingly, a distance of about +/−5% of chord length and/or +/−0.25 inches in a direction normal to a surface location along the airfoil profile defines an airfoil profile envelope for this particular airfoil design and compressor (i.e., a range of variation between measured points on the actual airfoil surface at nominal cold or room temperature and the ideal position of those points as given in TABLE 1 below at the same temperature). Additionally, a distance of about +/−5% of a chord length in a direction normal to an airfoil surface location along the airfoil profile also may define an airfoil profile envelope for this particular airfoil design. The data is scalable and the geometry pertains to all aerodynamic scales, at, above and/or below about 3,600 RPM. The stator vane airfoil design is robust to this range of variation without impairment of mechanical and aerodynamic functions.

The coordinate values given in scalable TABLE 1 below provide the nominal profile for an exemplary stage compressor stator vane.

TABLE 1

| SUCTION SIDE | | | PRESSURE SIDE | | |
|---|---|---|---|---|---|
| X | Y | Z | X | Y | Z |
| −1.2257 | 1.0575 | 0 | 1.6634 | −0.9911 | 0 |
| −1.2296 | 1.0533 | 0 | 1.6636 | −0.9904 | 0 |
| −1.2337 | 1.0468 | 0 | 1.6641 | −0.9891 | 0 |
| −1.2371 | 1.0379 | 0 | 1.6649 | −0.9863 | 0 |
| −1.239 | 1.0266 | 0 | 1.6657 | −0.9807 | 0 |
| −1.2389 | 1.0114 | 0 | 1.6651 | −0.9719 | 0 |
| −1.2356 | 0.9919 | 0 | 1.6581 | −0.9576 | 0 |
| −1.2285 | 0.9685 | 0 | 1.6404 | −0.9458 | 0 |
| −1.2173 | 0.941 | 0 | 1.6148 | −0.933 | 0 |
| −1.2027 | 0.9088 | 0 | 1.5828 | −0.9168 | 0 |
| −1.1845 | 0.8717 | 0 | 1.5415 | −0.8954 | 0 |
| −1.1615 | 0.8287 | 0 | 1.4944 | −0.8697 | 0 |
| −1.1334 | 0.78 | 0 | 1.4449 | −0.8408 | 0 |
| −1.0996 | 0.7261 | 0 | 1.3901 | −0.807 | 0 |
| −1.0602 | 0.6668 | 0 | 1.3298 | −0.7685 | 0 |
| −1.0146 | 0.6024 | 0 | 1.264 | −0.7254 | 0 |
| −0.9627 | 0.5336 | 0 | 1.196 | −0.6793 | 0 |
| −0.9069 | 0.4635 | 0 | 1.1257 | −0.6302 | 0 |
| −0.8471 | 0.3923 | 0 | 1.053 | −0.5781 | 0 |
| −0.783 | 0.3201 | 0 | 0.9781 | −0.5231 | 0 |
| −0.7146 | 0.247 | 0 | 0.9008 | −0.4652 | 0 |
| −0.6418 | 0.1731 | 0 | 0.8212 | −0.4044 | 0 |
| −0.5642 | 0.0988 | 0 | 0.7392 | −0.3408 | 0 |
| −0.4819 | 0.024 | 0 | 0.6548 | −0.2746 | 0 |
| −0.3975 | −0.0486 | 0 | 0.5707 | −0.2079 | 0 |
| −0.3109 | −0.119 | 0 | 0.4868 | −0.1411 | 0 |
| −0.2219 | −0.187 | 0 | 0.403 | −0.0741 | 0 |

TABLE 1-continued

| SUCTION SIDE | | | PRESSURE SIDE | | |
|---|---|---|---|---|---|
| X | Y | Z | X | Y | Z |
| −0.1305 | −0.2524 | 0 | 0.319 | −0.0073 | 0 |
| −0.0373 | −0.3147 | 0 | 0.2348 | 0.0592 | 0 |
| 0.0575 | −0.3735 | 0 | 0.15 | 0.125 | 0 |
| 0.1537 | −0.4292 | 0 | 0.0648 | 0.1902 | 0 |
| 0.2512 | −0.4821 | 0 | −0.0207 | 0.255 | 0 |
| 0.35 | −0.5324 | 0 | −0.1064 | 0.3196 | 0 |
| 0.4498 | −0.5803 | 0 | −0.1922 | 0.384 | 0 |
| 0.5507 | −0.626 | 0 | −0.2781 | 0.4483 | 0 |
| 0.6492 | −0.6682 | 0 | −0.3611 | 0.5105 | 0 |
| 0.7451 | −0.7071 | 0 | −0.4412 | 0.5705 | 0 |
| 0.8383 | −0.7432 | 0 | −0.5186 | 0.6282 | 0 |
| 0.9287 | −0.7766 | 0 | −0.5933 | 0.6837 | 0 |
| 1.016 | −0.8077 | 0 | −0.6651 | 0.7369 | 0 |
| 1.1003 | −0.8366 | 0 | −0.7343 | 0.7877 | 0 |
| 1.1814 | −0.8638 | 0 | −0.8009 | 0.836 | 0 |
| 1.2591 | −0.8893 | 0 | −0.8621 | 0.8795 | 0 |
| 1.33 | −0.9119 | 0 | −0.918 | 0.9182 | 0 |
| 1.3938 | −0.9321 | 0 | −0.9684 | 0.9522 | 0 |
| 1.4504 | −0.9504 | 0 | −1.0135 | 0.9812 | 0 |
| 1.5033 | −0.9682 | 0 | −1.0532 | 1.0055 | 0 |
| 1.549 | −0.984 | 0 | −1.0872 | 1.0252 | 0 |
| 1.5841 | −0.9962 | 0 | −1.1167 | 1.0414 | 0 |
| 1.6122 | −1.0059 | 0 | −1.142 | 1.0539 | 0 |
| 1.6337 | −1.0114 | 0 | −1.1636 | 1.0623 | 0 |
| 1.65 | −1.0067 | 0 | −1.1816 | 1.0667 | 0 |
| 1.6573 | −1.0007 | 0 | −1.1959 | 1.0678 | 0 |
| 1.661 | −0.9959 | 0 | −1.2066 | 1.0667 | 0 |
| 1.6624 | −0.9932 | 0 | −1.2151 | 1.0642 | 0 |
| 1.6631 | −0.9918 | 0 | −1.2215 | 1.0608 | 0 |
| −1.21 | 1.0383 | 0.765 | 1.6386 | −0.9778 | 0.765 |
| −1.2137 | 1.0341 | 0.765 | 1.6389 | −0.9772 | 0.765 |
| −1.2176 | 1.0277 | 0.765 | 1.6393 | −0.9758 | 0.765 |
| −1.2206 | 1.0189 | 0.765 | 1.6401 | −0.9731 | 0.765 |
| −1.2221 | 1.0078 | 0.765 | 1.6408 | −0.9676 | 0.765 |
| −1.2215 | 0.993 | 0.765 | 1.64 | −0.9589 | 0.765 |
| −1.2177 | 0.974 | 0.765 | 1.6324 | −0.9452 | 0.765 |
| −1.2102 | 0.9513 | 0.765 | 1.6144 | −0.9343 | 0.765 |
| −1.1988 | 0.9247 | 0.765 | 1.5892 | −0.9216 | 0.765 |
| −1.184 | 0.8934 | 0.765 | 1.5578 | −0.9057 | 0.765 |
| −1.1656 | 0.8574 | 0.765 | 1.517 | −0.8846 | 0.765 |
| −1.1425 | 0.8157 | 0.765 | 1.4706 | −0.8593 | 0.765 |
| −1.1143 | 0.7685 | 0.765 | 1.4218 | −0.831 | 0.765 |
| −1.0807 | 0.7162 | 0.765 | 1.3677 | −0.7979 | 0.765 |
| −1.0415 | 0.6586 | 0.765 | 1.3082 | −0.7602 | 0.765 |
| −0.9963 | 0.5962 | 0.765 | 1.2433 | −0.7179 | 0.765 |
| −0.9449 | 0.5294 | 0.765 | 1.1761 | −0.6727 | 0.765 |
| −0.8898 | 0.4613 | 0.765 | 1.1067 | −0.6246 | 0.765 |
| −0.8307 | 0.392 | 0.765 | 1.0349 | −0.5736 | 0.765 |
| −0.7676 | 0.3217 | 0.765 | 0.9609 | −0.5198 | 0.765 |
| −0.7003 | 0.2506 | 0.765 | 0.8845 | −0.463 | 0.765 |
| −0.6287 | 0.1787 | 0.765 | 0.8059 | −0.4035 | 0.765 |
| −0.5527 | 0.1063 | 0.765 | 0.7249 | −0.3413 | 0.765 |
| −0.4721 | 0.0335 | 0.765 | 0.6415 | −0.2764 | 0.765 |
| −0.3896 | −0.0373 | 0.765 | 0.5584 | −0.2111 | 0.765 |
| −0.3049 | −0.1059 | 0.765 | 0.4755 | −0.1456 | 0.765 |
| −0.2182 | −0.1722 | 0.765 | 0.3926 | −0.08 | 0.765 |
| −0.1292 | −0.2361 | 0.765 | 0.3097 | −0.0144 | 0.765 |
| −0.0379 | −0.2975 | 0.765 | 0.2266 | 0.0508 | 0.765 |
| 0.0552 | −0.3558 | 0.765 | 0.143 | 0.1154 | 0.765 |
| 0.1499 | −0.4112 | 0.765 | 0.059 | 0.1795 | 0.765 |
| 0.2461 | −0.464 | 0.765 | −0.0253 | 0.2432 | 0.765 |
| 0.3436 | −0.5143 | 0.765 | −0.1097 | 0.3067 | 0.765 |
| 0.4424 | −0.5624 | 0.765 | −0.1943 | 0.3701 | 0.765 |
| 0.5423 | −0.6084 | 0.765 | −0.2789 | 0.4334 | 0.765 |
| 0.6397 | −0.6508 | 0.765 | −0.3606 | 0.4947 | 0.765 |
| 0.7345 | −0.69 | 0.765 | −0.4395 | 0.5539 | 0.765 |
| 0.8266 | −0.7263 | 0.765 | −0.5156 | 0.6108 | 0.765 |
| 0.9157 | −0.7599 | 0.765 | −0.589 | 0.6656 | 0.765 |
| 1.0019 | −0.7913 | 0.765 | −0.6597 | 0.7181 | 0.765 |
| 1.0848 | −0.8204 | 0.765 | −0.7277 | 0.7683 | 0.765 |
| 1.1646 | −0.8478 | 0.765 | −0.7932 | 0.816 | 0.765 |
| 1.2411 | −0.8734 | 0.765 | −0.8533 | 0.8591 | 0.765 |
| 1.3107 | −0.8962 | 0.765 | −0.9081 | 0.8975 | 0.765 |
| 1.3735 | −0.9165 | 0.765 | −0.9576 | 0.9312 | 0.765 |
| 1.4292 | −0.9349 | 0.765 | −1.0018 | 0.9601 | 0.765 |
| 1.4812 | −0.9528 | 0.765 | −1.0407 | 0.9843 | 0.765 |

TABLE 1-continued

| SUCTION SIDE | | | PRESSURE SIDE | | |
|---|---|---|---|---|---|
| X | Y | Z | X | Y | Z |
| 1.5261 | −0.9687 | 0.765 | −1.074 | 1.004 | 0.765 |
| 1.5606 | −0.9809 | 0.765 | −1.1029 | 1.0202 | 0.765 |
| 1.5884 | −0.9905 | 0.765 | −1.1277 | 1.0329 | 0.765 |
| 1.6094 | −0.9965 | 0.765 | −1.1488 | 1.0416 | 0.765 |
| 1.6254 | −0.9927 | 0.765 | −1.1664 | 1.0463 | 0.765 |
| 1.6326 | −0.9871 | 0.765 | −1.1804 | 1.0478 | 0.765 |
| 1.6362 | −0.9824 | 0.765 | −1.191 | 1.0471 | 0.765 |
| 1.6377 | −0.9798 | 0.765 | −1.1995 | 1.0448 | 0.765 |
| 1.6383 | −0.9785 | 0.765 | −1.2058 | 1.0416 | 0.765 |
| −1.178 | 0.9993 | 2.365 | 1.5872 | −0.952 | 2.365 |
| −1.1815 | 0.9952 | 2.365 | 1.5874 | −0.9514 | 2.365 |
| −1.185 | 0.9889 | 2.365 | 1.5879 | −0.9501 | 2.365 |
| −1.1874 | 0.9802 | 2.365 | 1.5886 | −0.9475 | 2.365 |
| −1.1881 | 0.9694 | 2.365 | 1.5892 | −0.9421 | 2.365 |
| −1.1867 | 0.9551 | 2.365 | 1.5879 | −0.9337 | 2.365 |
| −1.1822 | 0.937 | 2.365 | 1.5793 | −0.9213 | 2.365 |
| −1.174 | 0.9153 | 2.365 | 1.5613 | −0.9114 | 2.365 |
| −1.1623 | 0.8896 | 2.365 | 1.537 | −0.8989 | 2.365 |
| −1.1474 | 0.8595 | 2.365 | 1.5066 | −0.8833 | 2.365 |
| −1.129 | 0.8249 | 2.365 | 1.4672 | −0.8628 | 2.365 |
| −1.106 | 0.7847 | 2.365 | 1.4223 | −0.8382 | 2.365 |
| −1.0779 | 0.7393 | 2.365 | 1.3751 | −0.8106 | 2.365 |
| −1.0444 | 0.6888 | 2.365 | 1.3228 | −0.7783 | 2.365 |
| −1.0055 | 0.6333 | 2.365 | 1.2653 | −0.7417 | 2.365 |
| −0.9609 | 0.5733 | 2.365 | 1.2025 | −0.7007 | 2.365 |
| −0.9103 | 0.5092 | 2.365 | 1.1374 | −0.6569 | 2.365 |
| −0.8561 | 0.4438 | 2.365 | 1.0701 | −0.6103 | 2.365 |
| −0.7981 | 0.3773 | 2.365 | 1.0005 | −0.5609 | 2.365 |
| −0.7361 | 0.3097 | 2.365 | 0.9287 | −0.5087 | 2.365 |
| −0.6701 | 0.2413 | 2.365 | 0.8547 | −0.4538 | 2.365 |
| −0.5998 | 0.172 | 2.365 | 0.7784 | −0.3963 | 2.365 |
| −0.5252 | 0.1022 | 2.365 | 0.6998 | −0.3361 | 2.365 |
| −0.4461 | 0.0319 | 2.365 | 0.6189 | −0.2734 | 2.365 |
| −0.3651 | −0.0364 | 2.365 | 0.5382 | −0.2103 | 2.365 |
| −0.2821 | −0.1028 | 2.365 | 0.4578 | −0.1469 | 2.365 |
| −0.1969 | −0.1669 | 2.365 | 0.3774 | −0.0835 | 2.365 |
| −0.11 | −0.2286 | 2.365 | 0.2969 | −0.0202 | 2.365 |
| −0.0217 | −0.2873 | 2.365 | 0.2162 | 0.0429 | 2.365 |
| 0.0682 | −0.343 | 2.365 | 0.1351 | 0.1053 | 2.365 |
| 0.1594 | −0.3961 | 2.365 | 0.0536 | 0.1673 | 2.365 |
| 0.2517 | −0.4466 | 2.365 | −0.0281 | 0.229 | 2.365 |
| 0.3452 | −0.495 | 2.365 | −0.11 | 0.2904 | 2.365 |
| 0.4397 | −0.5412 | 2.365 | −0.1921 | 0.3517 | 2.365 |
| 0.5352 | −0.5854 | 2.365 | −0.2741 | 0.4129 | 2.365 |
| 0.6283 | −0.6264 | 2.365 | −0.3534 | 0.4721 | 2.365 |
| 0.719 | −0.6645 | 2.365 | −0.4301 | 0.5293 | 2.365 |
| 0.8071 | −0.6999 | 2.365 | −0.504 | 0.5843 | 2.365 |
| 0.8925 | −0.7328 | 2.365 | −0.5753 | 0.6371 | 2.365 |
| 0.975 | −0.7636 | 2.365 | −0.644 | 0.6877 | 2.365 |
| 1.0547 | −0.7924 | 2.365 | −0.7101 | 0.7361 | 2.365 |
| 1.1313 | −0.8194 | 2.365 | −0.7737 | 0.7822 | 2.365 |
| 1.2047 | −0.8448 | 2.365 | −0.8321 | 0.8237 | 2.365 |
| 1.2716 | −0.8674 | 2.365 | −0.8853 | 0.8607 | 2.365 |
| 1.3319 | −0.8876 | 2.365 | −0.9334 | 0.8932 | 2.365 |
| 1.3854 | −0.9058 | 2.365 | −0.9764 | 0.9211 | 2.365 |
| 1.4353 | −0.9236 | 2.365 | −1.0142 | 0.9444 | 2.365 |
| 1.4784 | −0.9394 | 2.365 | −1.0465 | 0.9634 | 2.365 |
| 1.5116 | −0.9515 | 2.365 | −1.0745 | 0.9791 | 2.365 |
| 1.5382 | −0.9609 | 2.365 | −1.0985 | 0.9915 | 2.365 |
| 1.5583 | −0.9676 | 2.365 | −1.1188 | 1.0004 | 2.365 |
| 1.5739 | −0.9657 | 2.365 | −1.1357 | 1.0055 | 2.365 |
| 1.5812 | −0.9608 | 2.365 | −1.1492 | 1.0076 | 2.365 |
| 1.5848 | −0.9564 | 2.365 | −1.1594 | 1.0073 | 2.365 |
| 1.5863 | −0.954 | 2.365 | −1.1677 | 1.0055 | 2.365 |
| 1.5869 | −0.9527 | 2.365 | −1.1739 | 1.0025 | 2.365 |
| −1.1416 | 0.958 | 4.165 | 1.5298 | −0.9231 | 4.165 |
| −1.1449 | 0.954 | 4.165 | 1.53 | −0.9225 | 4.165 |
| −1.1476 | 0.9477 | 4.165 | 1.5305 | −0.9213 | 4.165 |
| −1.149 | 0.9392 | 4.165 | 1.5311 | −0.9187 | 4.165 |
| −1.1486 | 0.929 | 4.165 | 1.5315 | −0.9135 | 4.165 |
| −1.1457 | 0.9156 | 4.165 | 1.5296 | −0.9055 | 4.165 |
| −1.1398 | 0.899 | 4.165 | 1.5194 | −0.8951 | 4.165 |
| −1.1303 | 0.879 | 4.165 | 1.5018 | −0.8859 | 4.165 |
| −1.1175 | 0.8553 | 4.165 | 1.4784 | −0.8738 | 4.165 |
| −1.1017 | 0.8274 | 4.165 | 1.4491 | −0.8588 | 4.165 |
| −1.0824 | 0.7954 | 4.165 | 1.411 | −0.839 | 4.165 |

TABLE 1-continued

| SUCTION SIDE | | | PRESSURE SIDE | | |
|---|---|---|---|---|---|
| X | Y | Z | X | Y | Z |
| −1.0585 | 0.7582 | 4.165 | 1.3676 | −0.8154 | 4.165 |
| −1.0297 | 0.7159 | 4.165 | 1.3221 | −0.789 | 4.165 |
| −0.9957 | 0.6691 | 4.165 | 1.2714 | −0.7583 | 4.165 |
| −0.9566 | 0.6178 | 4.165 | 1.2157 | −0.7234 | 4.165 |
| −0.9122 | 0.5622 | 4.165 | 1.1547 | −0.6844 | 4.165 |
| −0.8622 | 0.5024 | 4.165 | 1.0914 | −0.643 | 4.165 |
| −0.8087 | 0.4413 | 4.165 | 1.0259 | −0.5988 | 4.165 |
| −0.7516 | 0.379 | 4.165 | 0.9582 | −0.5521 | 4.165 |
| −0.6907 | 0.3154 | 4.165 | 0.8882 | −0.5028 | 4.165 |
| −0.626 | 0.2507 | 4.165 | 0.816 | −0.451 | 4.165 |
| −0.5574 | 0.1851 | 4.165 | 0.7416 | −0.3967 | 4.165 |
| −0.4846 | 0.1187 | 4.165 | 0.665 | −0.3399 | 4.165 |
| −0.4079 | 0.0518 | 4.165 | 0.586 | −0.2807 | 4.165 |
| −0.3299 | −0.013 | 4.165 | 0.5073 | −0.2211 | 4.165 |
| −0.2505 | −0.0758 | 4.165 | 0.4289 | −0.1613 | 4.165 |
| −0.1699 | −0.1364 | 4.165 | 0.3505 | −0.1012 | 4.165 |
| −0.0878 | −0.1949 | 4.165 | 0.2722 | −0.0412 | 4.165 |
| −0.0043 | −0.2512 | 4.165 | 0.1937 | 0.0187 | 4.165 |
| 0.0808 | −0.3051 | 4.165 | 0.115 | 0.0783 | 4.165 |
| 0.1672 | −0.3568 | 4.165 | 0.0361 | 0.1375 | 4.165 |
| 0.2549 | −0.4065 | 4.165 | −0.043 | 0.1966 | 4.165 |
| 0.3438 | −0.4544 | 4.165 | −0.1221 | 0.2557 | 4.165 |
| 0.4339 | −0.5005 | 4.165 | −0.2012 | 0.3147 | 4.165 |
| 0.525 | −0.545 | 4.165 | −0.2802 | 0.3738 | 4.165 |
| 0.614 | −0.5865 | 4.165 | −0.3565 | 0.4312 | 4.165 |
| 0.7008 | −0.6251 | 4.165 | −0.4301 | 0.4866 | 4.165 |
| 0.7849 | −0.6612 | 4.165 | −0.501 | 0.54 | 4.165 |
| 0.8664 | −0.6949 | 4.165 | −0.5693 | 0.5915 | 4.165 |
| 0.9452 | −0.7263 | 4.165 | −0.635 | 0.641 | 4.165 |
| 1.0211 | −0.7558 | 4.165 | −0.6981 | 0.6884 | 4.165 |
| 1.094 | −0.7835 | 4.165 | −0.7588 | 0.7337 | 4.165 |
| 1.164 | −0.8095 | 4.165 | −0.8144 | 0.7747 | 4.165 |
| 1.2277 | −0.8327 | 4.165 | −0.8649 | 0.8115 | 4.165 |
| 1.2852 | −0.8533 | 4.165 | −0.9104 | 0.844 | 4.165 |
| 1.3362 | −0.8718 | 4.165 | −0.9511 | 0.872 | 4.165 |
| 1.3838 | −0.8898 | 4.165 | −0.9867 | 0.8956 | 4.165 |
| 1.4249 | −0.9059 | 4.165 | −1.0173 | 0.915 | 4.165 |
| 1.4566 | −0.918 | 4.165 | −1.0436 | 0.9312 | 4.165 |
| 1.482 | −0.9274 | 4.165 | −1.0661 | 0.9443 | 4.165 |
| 1.5012 | −0.9343 | 4.165 | −1.085 | 0.9542 | 4.165 |
| 1.5162 | −0.9352 | 4.165 | −1.1008 | 0.9606 | 4.165 |
| 1.5237 | −0.9313 | 4.165 | −1.1136 | 0.9637 | 4.165 |
| 1.5274 | −0.9273 | 4.165 | −1.1234 | 0.9645 | 4.165 |
| 1.5289 | −0.925 | 4.165 | −1.1316 | 0.9635 | 4.165 |
| 1.5295 | −0.9238 | 4.165 | −1.1377 | 0.961 | 4.165 |
| −1.1035 | 0.9199 | 5.965 | 1.4714 | −0.8954 | 5.965 |
| −1.1065 | 0.916 | 5.965 | 1.4717 | −0.8948 | 5.965 |
| −1.1088 | 0.9098 | 5.965 | 1.4721 | −0.8936 | 5.965 |
| −1.1094 | 0.9015 | 5.965 | 1.4727 | −0.8912 | 5.965 |
| −1.1082 | 0.8917 | 5.965 | 1.473 | −0.8861 | 5.965 |
| −1.1047 | 0.8791 | 5.965 | 1.4706 | −0.8786 | 5.965 |
| −1.0981 | 0.8635 | 5.965 | 1.4598 | −0.8695 | 5.965 |
| −1.0884 | 0.8445 | 5.965 | 1.443 | −0.8605 | 5.965 |
| −1.0759 | 0.8219 | 5.965 | 1.4205 | −0.8486 | 5.965 |
| −1.0604 | 0.7953 | 5.965 | 1.3924 | −0.834 | 5.965 |
| −1.0415 | 0.7647 | 5.965 | 1.3557 | −0.8149 | 5.965 |
| −1.0181 | 0.7291 | 5.965 | 1.314 | −0.792 | 5.965 |
| −0.9899 | 0.6889 | 5.965 | 1.2701 | −0.7664 | 5.965 |
| −0.9566 | 0.6444 | 5.965 | 1.2214 | −0.7367 | 5.965 |
| −0.9183 | 0.5957 | 5.965 | 1.1677 | −0.7031 | 5.965 |
| −0.8751 | 0.5427 | 5.965 | 1.1089 | −0.6655 | 5.965 |
| −0.8265 | 0.4857 | 5.965 | 1.0479 | −0.6256 | 5.965 |
| −0.7745 | 0.4275 | 5.965 | 0.9848 | −0.5831 | 5.965 |
| −0.7189 | 0.368 | 5.965 | 0.9195 | −0.5381 | 5.965 |
| −0.6599 | 0.3073 | 5.965 | 0.852 | −0.4907 | 5.965 |
| −0.5971 | 0.2456 | 5.965 | 0.7825 | −0.4409 | 5.965 |
| −0.5305 | 0.183 | 5.965 | 0.7107 | −0.3886 | 5.965 |
| −0.4602 | 0.1197 | 5.965 | 0.6368 | −0.334 | 5.965 |
| −0.3862 | 0.0561 | 5.965 | 0.5607 | −0.277 | 5.965 |
| −0.3111 | −0.0057 | 5.965 | 0.4848 | −0.2197 | 5.965 |
| −0.2347 | −0.0656 | 5.965 | 0.4091 | −0.162 | 5.965 |
| −0.1571 | −0.1236 | 5.965 | 0.3336 | −0.1042 | 5.965 |
| −0.0781 | −0.1796 | 5.965 | 0.2582 | −0.0463 | 5.965 |
| 0.0022 | −0.2335 | 5.965 | 0.1826 | 0.0114 | 5.965 |
| 0.0839 | −0.2854 | 5.965 | 0.1068 | 0.0689 | 5.965 |
| 0.1669 | −0.3352 | 5.965 | 0.0308 | 0.1261 | 5.965 |

TABLE 1-continued

| SUCTION SIDE | | | PRESSURE SIDE | | |
|---|---|---|---|---|---|
| X | Y | Z | X | Y | Z |
| 0.251 | −0.3833 | 5.965 | −0.0453 | 0.1832 | 5.965 |
| 0.3363 | −0.4297 | 5.965 | −0.1214 | 0.2401 | 5.965 |
| 0.4226 | −0.4745 | 5.965 | −0.1976 | 0.2971 | 5.965 |
| 0.5099 | −0.5179 | 5.965 | −0.2737 | 0.3542 | 5.965 |
| 0.5951 | −0.5584 | 5.965 | −0.3471 | 0.4095 | 5.965 |
| 0.6781 | −0.5964 | 5.965 | −0.418 | 0.4629 | 5.965 |
| 0.7586 | −0.6319 | 5.965 | −0.4864 | 0.5145 | 5.965 |
| 0.8366 | −0.6651 | 5.965 | −0.5522 | 0.5641 | 5.965 |
| 0.9119 | −0.6963 | 5.965 | −0.6155 | 0.6118 | 5.965 |
| 0.9844 | −0.7256 | 5.965 | −0.6764 | 0.6575 | 5.965 |
| 1.0541 | −0.7531 | 5.965 | −0.7349 | 0.7009 | 5.965 |
| 1.121 | −0.7791 | 5.965 | −0.7885 | 0.7404 | 5.965 |
| 1.1819 | −0.8023 | 5.965 | −0.8371 | 0.776 | 5.965 |
| 1.2369 | −0.8229 | 5.965 | −0.881 | 0.8073 | 5.965 |
| 1.2856 | −0.8414 | 5.965 | −0.9202 | 0.8343 | 5.965 |
| 1.3311 | −0.8595 | 5.965 | −0.9546 | 0.8569 | 5.965 |
| 1.3703 | −0.8755 | 5.965 | −0.9841 | 0.8755 | 5.965 |
| 1.4006 | −0.8875 | 5.965 | −1.0096 | 0.891 | 5.965 |
| 1.4249 | −0.8969 | 5.965 | −1.0312 | 0.9036 | 5.965 |
| 1.4433 | −0.9036 | 5.965 | −1.0493 | 0.9135 | 5.965 |
| 1.4576 | −0.9062 | 5.965 | −1.0643 | 0.9202 | 5.965 |
| 1.4652 | −0.903 | 5.965 | −1.0764 | 0.9239 | 5.965 |
| 1.469 | −0.8994 | 5.965 | −1.0858 | 0.9252 | 5.965 |
| 1.4705 | −0.8972 | 5.965 | −1.0937 | 0.9248 | 5.965 |
| 1.4711 | −0.896 | 5.965 | −1.0997 | 0.9227 | 5.965 |
| −1.0529 | 0.8737 | 8.265 | 1.3957 | −0.8606 | 8.265 |
| −1.0555 | 0.8698 | 8.265 | 1.3959 | −0.86 | 8.265 |
| −1.057 | 0.8637 | 8.265 | 1.3963 | −0.8589 | 8.265 |
| −1.0566 | 0.8559 | 8.265 | 1.397 | −0.8565 | 8.265 |
| −1.0545 | 0.8468 | 8.265 | 1.3972 | −0.8517 | 8.265 |
| −1.05 | 0.8352 | 8.265 | 1.3948 | −0.8445 | 8.265 |
| −1.0428 | 0.8207 | 8.265 | 1.3843 | −0.8361 | 8.265 |
| −1.0329 | 0.8032 | 8.265 | 1.3684 | −0.8274 | 8.265 |
| −1.0204 | 0.782 | 8.265 | 1.3471 | −0.816 | 8.265 |
| −1.005 | 0.7573 | 8.265 | 1.3204 | −0.8018 | 8.265 |
| −0.9862 | 0.7287 | 8.265 | 1.2857 | −0.7833 | 8.265 |
| −0.9632 | 0.6956 | 8.265 | 1.2462 | −0.7611 | 8.265 |
| −0.9356 | 0.6581 | 8.265 | 1.2046 | −0.7366 | 8.265 |
| −0.9033 | 0.6166 | 8.265 | 1.1583 | −0.7081 | 8.265 |
| −0.8661 | 0.5712 | 8.265 | 1.1073 | −0.6759 | 8.265 |
| −0.8242 | 0.5216 | 8.265 | 1.0514 | −0.64 | 8.265 |
| −0.7773 | 0.4681 | 8.265 | 0.9934 | −0.6019 | 8.265 |
| −0.7271 | 0.4134 | 8.265 | 0.9334 | −0.5613 | 8.265 |
| −0.6736 | 0.3574 | 8.265 | 0.8712 | −0.5185 | 8.265 |
| −0.6169 | 0.3003 | 8.265 | 0.807 | −0.4735 | 8.265 |
| −0.557 | 0.2423 | 8.265 | 0.7407 | −0.4261 | 8.265 |
| −0.4938 | 0.1837 | 8.265 | 0.6723 | −0.3766 | 8.265 |
| −0.4272 | 0.1244 | 8.265 | 0.6018 | −0.3248 | 8.265 |
| −0.3573 | 0.0646 | 8.265 | 0.5292 | −0.2708 | 8.265 |
| −0.2862 | 0.0063 | 8.265 | 0.4569 | −0.2164 | 8.265 |
| −0.214 | −0.0504 | 8.265 | 0.3847 | −0.1618 | 8.265 |
| −0.1406 | −0.1054 | 8.265 | 0.3126 | −0.1071 | 8.265 |
| −0.066 | −0.1587 | 8.265 | 0.2406 | −0.0522 | 8.265 |
| 0.0098 | −0.2104 | 8.265 | 0.1686 | 0.0025 | 8.265 |
| 0.087 | −0.2601 | 8.265 | 0.0963 | 0.057 | 8.265 |
| 0.1654 | −0.3082 | 8.265 | 0.024 | 0.1114 | 8.265 |
| 0.2449 | −0.3548 | 8.265 | −0.0485 | 0.1656 | 8.265 |
| 0.3255 | −0.3999 | 8.265 | −0.1209 | 0.2198 | 8.265 |
| 0.4071 | −0.4437 | 8.265 | −0.1934 | 0.274 | 8.265 |
| 0.4896 | −0.4861 | 8.265 | −0.2658 | 0.3284 | 8.265 |
| 0.57 | −0.5259 | 8.265 | −0.3356 | 0.381 | 8.265 |
| 0.6482 | −0.5631 | 8.265 | −0.4031 | 0.4318 | 8.265 |
| 0.7241 | −0.5981 | 8.265 | −0.4681 | 0.4809 | 8.265 |
| 0.7975 | −0.6309 | 8.265 | −0.5306 | 0.5282 | 8.265 |
| 0.8685 | −0.6618 | 8.265 | −0.5908 | 0.5736 | 8.265 |
| 0.9368 | −0.6908 | 8.265 | −0.6487 | 0.6172 | 8.265 |
| 1.0025 | −0.7182 | 8.265 | −0.7043 | 0.6586 | 8.265 |
| 1.0655 | −0.744 | 8.265 | −0.7552 | 0.6963 | 8.265 |
| 1.123 | −0.7671 | 8.265 | −0.8013 | 0.7304 | 8.265 |
| 1.1747 | −0.7876 | 8.265 | −0.8428 | 0.7605 | 8.265 |
| 1.2207 | −0.8061 | 8.265 | −0.8799 | 0.7864 | 8.265 |
| 1.2636 | −0.8239 | 8.265 | −0.9124 | 0.8083 | 8.265 |
| 1.3006 | −0.8396 | 8.265 | −0.9403 | 0.8263 | 8.265 |
| 1.3291 | −0.8516 | 8.265 | −0.9644 | 0.8413 | 8.265 |
| 1.3521 | −0.8609 | 8.265 | −0.9848 | 0.8536 | 8.265 |
| 1.3694 | −0.8676 | 8.265 | −1.0018 | 0.8634 | 8.265 |

TABLE 1-continued

| SUCTION SIDE | | | PRESSURE SIDE | | |
|---|---|---|---|---|---|
| X | Y | Z | X | Y | Z |
| 1.3827 | −0.8703 | 8.265 | −1.0157 | 0.8706 | 8.265 |
| 1.3898 | −0.8675 | 8.265 | −1.0269 | 0.875 | 8.265 |
| 1.3934 | −0.8642 | 8.265 | −1.0357 | 0.8771 | 8.265 |
| 1.3948 | −0.8622 | 8.265 | −1.0432 | 0.8775 | 8.265 |
| 1.3954 | −0.8611 | 8.265 | −1.0491 | 0.8762 | 8.265 |
| −1 | 0.8293 | 10.565 | 1.3182 | −0.827 | 10.565 |
| −1.002 | 0.8254 | 10.565 | 1.3185 | −0.8265 | 10.565 |
| −1.002 | 0.8195 | 10.565 | 1.3189 | −0.8254 | 10.565 |
| −1 | 0.8125 | 10.565 | 1.3195 | −0.8232 | 10.565 |
| −0.9965 | 0.8045 | 10.565 | 1.3197 | −0.8186 | 10.565 |
| −0.9906 | 0.7944 | 10.565 | 1.3173 | −0.8118 | 10.565 |
| −0.9823 | 0.7818 | 10.565 | 1.3072 | −0.8041 | 10.565 |
| −0.9716 | 0.7662 | 10.565 | 1.2919 | −0.7962 | 10.565 |
| −0.9581 | 0.7475 | 10.565 | 1.2715 | −0.7857 | 10.565 |
| −0.9416 | 0.7257 | 10.565 | 1.2462 | −0.7723 | 10.565 |
| −0.9218 | 0.7005 | 10.565 | 1.2134 | −0.7547 | 10.565 |
| −0.8979 | 0.6712 | 10.565 | 1.1758 | −0.7338 | 10.565 |
| −0.8699 | 0.6378 | 10.565 | 1.136 | −0.7111 | 10.565 |
| −0.8375 | 0.6005 | 10.565 | 1.0916 | −0.685 | 10.565 |
| −0.8005 | 0.5595 | 10.565 | 1.0425 | −0.6555 | 10.565 |
| −0.759 | 0.5147 | 10.565 | 0.9888 | −0.6226 | 10.565 |
| −0.7129 | 0.4663 | 10.565 | 0.9329 | −0.5877 | 10.565 |
| −0.664 | 0.4167 | 10.565 | 0.875 | −0.5508 | 10.565 |
| −0.6124 | 0.3659 | 10.565 | 0.815 | −0.5117 | 10.565 |
| −0.5579 | 0.314 | 10.565 | 0.753 | −0.4706 | 10.565 |
| −0.5005 | 0.261 | 10.565 | 0.6889 | −0.4274 | 10.565 |
| −0.4401 | 0.207 | 10.565 | 0.6228 | −0.3821 | 10.565 |
| −0.3767 | 0.1521 | 10.565 | 0.5547 | −0.3346 | 10.565 |
| −0.3102 | 0.0963 | 10.565 | 0.4845 | −0.2851 | 10.565 |
| −0.2427 | 0.0417 | 10.565 | 0.4147 | −0.2351 | 10.565 |
| −0.1743 | −0.0118 | 10.565 | 0.3451 | −0.1848 | 10.565 |
| −0.1048 | −0.0641 | 10.565 | 0.2758 | −0.1341 | 10.565 |
| −0.0343 | −0.1153 | 10.565 | 0.2067 | −0.083 | 10.565 |
| 0.0372 | −0.1653 | 10.565 | 0.1377 | −0.0319 | 10.565 |
| 0.1096 | −0.2139 | 10.565 | 0.0688 | 0.0194 | 10.565 |
| 0.1828 | −0.2612 | 10.565 | 0 | 0.0708 | 10.565 |
| 0.2568 | −0.3073 | 10.565 | −0.0686 | 0.1225 | 10.565 |
| 0.3314 | −0.3522 | 10.565 | −0.1371 | 0.1743 | 10.565 |
| 0.4068 | −0.3961 | 10.565 | −0.2054 | 0.2263 | 10.565 |
| 0.4828 | −0.4389 | 10.565 | −0.2735 | 0.2787 | 10.565 |
| 0.5568 | −0.4793 | 10.565 | −0.3391 | 0.3296 | 10.565 |
| 0.6287 | −0.5174 | 10.565 | −0.4022 | 0.379 | 10.565 |
| 0.6985 | −0.5533 | 10.565 | −0.463 | 0.4268 | 10.565 |
| 0.766 | −0.5873 | 10.565 | −0.5213 | 0.4731 | 10.565 |
| 0.8313 | −0.6193 | 10.565 | −0.5773 | 0.5177 | 10.565 |
| 0.8942 | −0.6496 | 10.565 | −0.6309 | 0.5607 | 10.565 |
| 0.9546 | −0.6781 | 10.565 | −0.6823 | 0.6019 | 10.565 |
| 1.0127 | −0.7051 | 10.565 | −0.7292 | 0.6395 | 10.565 |
| 1.0655 | −0.7292 | 10.565 | −0.7717 | 0.6735 | 10.565 |
| 1.1132 | −0.7508 | 10.565 | −0.8098 | 0.7038 | 10.565 |
| 1.1556 | −0.7699 | 10.565 | −0.8436 | 0.7302 | 10.565 |
| 1.1954 | −0.7879 | 10.565 | −0.873 | 0.753 | 10.565 |
| 1.2298 | −0.8036 | 10.565 | −0.8981 | 0.7721 | 10.565 |
| 1.2562 | −0.8157 | 10.565 | −0.9198 | 0.7881 | 10.565 |
| 1.2774 | −0.8254 | 10.565 | −0.9382 | 0.8012 | 10.565 |
| 1.2932 | −0.8326 | 10.565 | −0.9535 | 0.8118 | 10.565 |
| 1.3057 | −0.8359 | 10.565 | −0.9659 | 0.82 | 10.565 |
| 1.3125 | −0.8335 | 10.565 | −0.9758 | 0.8257 | 10.565 |
| 1.316 | −0.8305 | 10.565 | −0.9836 | 0.8293 | 10.565 |
| 1.3174 | −0.8286 | 10.565 | −0.9905 | 0.8312 | 10.565 |
| 1.318 | −0.8276 | 10.565 | −0.9962 | 0.8312 | 10.565 |
| −0.9907 | 0.8214 | 10.965 | 1.3046 | −0.8215 | 10.965 |
| −0.9925 | 0.8175 | 10.965 | 1.3049 | −0.821 | 10.965 |
| −0.9922 | 0.8117 | 10.965 | 1.3053 | −0.8199 | 10.965 |
| −0.99 | 0.8049 | 10.965 | 1.3059 | −0.8177 | 10.965 |
| −0.9861 | 0.7971 | 10.965 | 1.3061 | −0.8131 | 10.965 |
| −0.98 | 0.7874 | 10.965 | 1.3038 | −0.8064 | 10.965 |
| −0.9715 | 0.775 | 10.965 | 1.2938 | −0.7987 | 10.965 |
| −0.9606 | 0.7599 | 10.965 | 1.2786 | −0.7909 | 10.965 |
| −0.9469 | 0.7417 | 10.965 | 1.2585 | −0.7805 | 10.965 |
| −0.9303 | 0.7204 | 10.965 | 1.2333 | −0.7673 | 10.965 |
| −0.9103 | 0.6959 | 10.965 | 1.2008 | −0.7498 | 10.965 |
| −0.8863 | 0.6673 | 10.965 | 1.1635 | −0.7293 | 10.965 |
| −0.8582 | 0.6346 | 10.965 | 1.1241 | −0.7069 | 10.965 |
| −0.8257 | 0.598 | 10.965 | 1.0799 | −0.6812 | 10.965 |
| −0.7887 | 0.5578 | 10.965 | 1.0311 | −0.6523 | 10.965 |

TABLE 1-continued

| SUCTION SIDE | | | PRESSURE SIDE | | |
|---|---|---|---|---|---|
| X | Y | Z | X | Y | Z |
| −0.7473 | 0.5139 | 10.965 | 0.9777 | −0.62 | 10.965 |
| −0.7014 | 0.4665 | 10.965 | 0.9222 | −0.5857 | 10.965 |
| −0.6527 | 0.4178 | 10.965 | 0.8646 | −0.5494 | 10.965 |
| −0.6013 | 0.3679 | 10.965 | 0.8049 | −0.5111 | 10.965 |
| −0.5471 | 0.3167 | 10.965 | 0.7432 | −0.4707 | 10.965 |
| −0.4901 | 0.2645 | 10.965 | 0.6795 | −0.4283 | 10.965 |
| −0.4301 | 0.2113 | 10.965 | 0.6137 | −0.3838 | 10.965 |
| −0.3671 | 0.157 | 10.965 | 0.546 | −0.3372 | 10.965 |
| −0.3011 | 0.1019 | 10.965 | 0.4762 | −0.2885 | 10.965 |
| −0.2341 | 0.0479 | 10.965 | 0.4068 | −0.2393 | 10.965 |
| −0.1662 | −0.0051 | 10.965 | 0.3376 | −0.1897 | 10.965 |
| −0.0973 | −0.0571 | 10.965 | 0.2688 | −0.1397 | 10.965 |
| −0.0277 | −0.1079 | 10.965 | 0.2001 | −0.0894 | 10.965 |
| 0.0428 | −0.1574 | 10.965 | 0.1317 | −0.0389 | 10.965 |
| 0.1142 | −0.2057 | 10.965 | 0.0633 | 0.0118 | 10.965 |
| 0.1863 | −0.2528 | 10.965 | −0.0048 | 0.0628 | 10.965 |
| 0.2592 | −0.2988 | 10.965 | −0.0728 | 0.1139 | 10.965 |
| 0.3328 | −0.3437 | 10.965 | −0.1406 | 0.1653 | 10.965 |
| 0.407 | −0.3877 | 10.965 | −0.2082 | 0.217 | 10.965 |
| 0.4818 | −0.4306 | 10.965 | −0.2755 | 0.2691 | 10.965 |
| 0.5546 | −0.4711 | 10.965 | −0.3404 | 0.3197 | 10.965 |
| 0.6254 | −0.5094 | 10.965 | −0.4027 | 0.3689 | 10.965 |
| 0.6941 | −0.5456 | 10.965 | −0.4627 | 0.4166 | 10.965 |
| 0.7605 | −0.5798 | 10.965 | −0.5203 | 0.4627 | 10.965 |
| 0.8247 | −0.6121 | 10.965 | −0.5755 | 0.5072 | 10.965 |
| 0.8866 | −0.6426 | 10.965 | −0.6283 | 0.5501 | 10.965 |
| 0.9461 | −0.6714 | 10.965 | −0.6789 | 0.5913 | 10.965 |
| 1.0032 | −0.6986 | 10.965 | −0.7251 | 0.6289 | 10.965 |
| 1.0553 | −0.723 | 10.965 | −0.7669 | 0.663 | 10.965 |
| 1.1022 | −0.7448 | 10.965 | −0.8043 | 0.6934 | 10.965 |
| 1.144 | −0.764 | 10.965 | −0.8376 | 0.72 | 10.965 |
| 1.1831 | −0.7821 | 10.965 | −0.8664 | 0.7429 | 10.965 |
| 1.217 | −0.7979 | 10.965 | −0.891 | 0.7622 | 10.965 |
| 1.2431 | −0.81 | 10.965 | −0.9122 | 0.7784 | 10.965 |
| 1.264 | −0.8197 | 10.965 | −0.9302 | 0.7917 | 10.965 |
| 1.2796 | −0.827 | 10.965 | −0.9452 | 0.8024 | 10.965 |
| 1.292 | −0.8303 | 10.965 | −0.9573 | 0.8108 | 10.965 |
| 1.2988 | −0.828 | 10.965 | −0.9669 | 0.8168 | 10.965 |
| 1.3024 | −0.8249 | 10.965 | −0.9745 | 0.8206 | 10.965 |
| 1.3038 | −0.823 | 10.965 | −0.9812 | 0.8229 | 10.965 |
| 1.3043 | −0.822 | 10.965 | −0.9869 | 0.8232 | 10.965 |
| −0.9768 | 0.8107 | 11.565 | 1.2842 | −0.813 | 11.565 |
| −0.9784 | 0.8068 | 11.565 | 1.2845 | −0.8125 | 11.565 |
| −0.9776 | 0.8012 | 11.565 | 1.2849 | −0.8114 | 11.565 |
| −0.975 | 0.7946 | 11.565 | 1.2855 | −0.8093 | 11.565 |
| −0.9709 | 0.7871 | 11.565 | 1.2858 | −0.8047 | 11.565 |
| −0.9646 | 0.7777 | 11.565 | 1.2836 | −0.7981 | 11.565 |
| −0.9561 | 0.7656 | 11.565 | 1.2739 | −0.7903 | 11.565 |
| −0.9451 | 0.7508 | 11.565 | 1.2589 | −0.7826 | 11.565 |
| −0.9314 | 0.7331 | 11.565 | 1.2391 | −0.7723 | 11.565 |
| −0.9147 | 0.7124 | 11.565 | 1.2143 | −0.7592 | 11.565 |
| −0.8947 | 0.6885 | 11.565 | 1.1823 | −0.742 | 11.565 |
| −0.8707 | 0.6606 | 11.565 | 1.1455 | −0.7217 | 11.565 |
| −0.8427 | 0.6287 | 11.565 | 1.1066 | −0.6996 | 11.565 |
| −0.8104 | 0.5929 | 11.565 | 1.063 | −0.6744 | 11.565 |
| −0.7736 | 0.5537 | 11.565 | 1.0148 | −0.6459 | 11.565 |
| −0.7326 | 0.5108 | 11.565 | 0.9621 | −0.6142 | 11.565 |
| −0.6871 | 0.4644 | 11.565 | 0.9073 | −0.5805 | 11.565 |
| −0.6389 | 0.4167 | 11.565 | 0.8504 | −0.5448 | 11.565 |
| −0.588 | 0.3678 | 11.565 | 0.7915 | −0.5072 | 11.565 |
| −0.5344 | 0.3176 | 11.565 | 0.7305 | −0.4675 | 11.565 |
| −0.478 | 0.2663 | 11.565 | 0.6676 | −0.4259 | 11.565 |
| −0.4187 | 0.214 | 11.565 | 0.6026 | −0.3821 | 11.565 |
| −0.3564 | 0.1606 | 11.565 | 0.5357 | −0.3364 | 11.565 |
| −0.2912 | 0.1063 | 11.565 | 0.4668 | −0.2885 | 11.565 |
| −0.2251 | 0.053 | 11.565 | 0.3982 | −0.2402 | 11.565 |
| −0.1582 | 0.0008 | 11.565 | 0.3299 | −0.1914 | 11.565 |
| −0.0906 | −0.0503 | 11.565 | 0.2619 | −0.1422 | 11.565 |
| −0.0221 | −0.1004 | 11.565 | 0.1941 | −0.0927 | 11.565 |
| 0.0471 | −0.1494 | 11.565 | 0.1266 | −0.0429 | 11.565 |
| 0.1172 | −0.1972 | 11.565 | 0.0592 | 0.0071 | 11.565 |
| 0.188 | −0.2439 | 11.565 | −0.008 | 0.0573 | 11.565 |
| 0.2595 | −0.2897 | 11.565 | −0.075 | 0.1078 | 11.565 |
| 0.3317 | −0.3344 | 11.565 | −0.1418 | 0.1586 | 11.565 |
| 0.4044 | −0.3781 | 11.565 | −0.2084 | 0.2097 | 11.565 |
| 0.4777 | −0.4209 | 11.565 | −0.2747 | 0.2612 | 11.565 |

TABLE 1-continued

| SUCTION SIDE | | | PRESSURE SIDE | | |
|---|---|---|---|---|---|
| X | Y | Z | X | Y | Z |
| 0.5491 | −0.4615 | 11.565 | −0.3385 | 0.3112 | 11.565 |
| 0.6185 | −0.4998 | 11.565 | −0.3999 | 0.3599 | 11.565 |
| 0.6858 | −0.5361 | 11.565 | −0.4589 | 0.4071 | 11.565 |
| 0.7509 | −0.5703 | 11.565 | −0.5155 | 0.4527 | 11.565 |
| 0.8138 | −0.6028 | 11.565 | −0.5698 | 0.4968 | 11.565 |
| 0.8744 | −0.6334 | 11.565 | −0.6217 | 0.5393 | 11.565 |
| 0.9327 | −0.6624 | 11.565 | −0.6715 | 0.5802 | 11.565 |
| 0.9886 | −0.6897 | 11.565 | −0.7168 | 0.6175 | 11.565 |
| 1.0397 | −0.7142 | 11.565 | −0.7578 | 0.6514 | 11.565 |
| 1.0857 | −0.7361 | 11.565 | −0.7946 | 0.6815 | 11.565 |
| 1.1266 | −0.7555 | 11.565 | −0.8271 | 0.708 | 11.565 |
| 1.165 | −0.7737 | 11.565 | −0.8554 | 0.7308 | 11.565 |
| 1.1982 | −0.7895 | 11.565 | −0.8794 | 0.7501 | 11.565 |
| 1.2238 | −0.8016 | 11.565 | −0.9001 | 0.7663 | 11.565 |
| 1.2443 | −0.8113 | 11.565 | −0.9177 | 0.7796 | 11.565 |
| 1.2596 | −0.8185 | 11.565 | −0.9324 | 0.7904 | 11.565 |
| 1.2718 | −0.8217 | 11.565 | −0.9443 | 0.7988 | 11.565 |
| 1.2785 | −0.8194 | 11.565 | −0.9536 | 0.8049 | 11.565 |
| 1.282 | −0.8164 | 11.565 | −0.961 | 0.809 | 11.565 |
| 1.2834 | −0.8145 | 11.565 | −0.9675 | 0.8115 | 11.565 |
| 1.2839 | −0.8135 | 11.565 | −0.973 | 0.8123 | 11.565 |

It will also be appreciated that the airfoil 200 disclosed in the above scalable TABLE 1 may be non-scaled, scaled up, or scaled down geometrically for use in other similar turbine/compressor designs. Consequently, the coordinate values set forth in TABLE 1 may be non-scaled, scaled upwardly, or scaled downwardly such that the general airfoil profile shape remains unchanged. A scaled version of the coordinates in TABLE 1 would be represented by X, Y, and Z coordinate values of TABLE 1, with the X, Y, and Z non-dimensional coordinate values converted to inches or mm (or any suitable dimensional system), and then multiplied or divided by a constant number. The constant number may be a fraction, decimal fraction, integer or mixed number.

The article of manufacture may also have a suction-side nominal airfoil profile substantially in accordance with suction-side Cartesian coordinate values of X, Y, and Z set forth in the scalable table identified herein as TABLE 1. The Cartesian coordinate values of X, circumferentially Y, and Z are non-dimensional values convertible to dimensional distances by multiplying the Cartesian coordinate values of X, Y, and Z by a number. The X and Y coordinates, when connected by smooth continuing arcs, define airfoil profile sections at each Z height. The airfoil profile sections at each Z height are joined smoothly with one another to form a complete suction-side airfoil shape. The X, Y, and Z coordinate values are scalable as a function of a number to provide a non-scaled, scaled-up, or scaled-down airfoil profile.

The article of manufacture may also have a pressure-side nominal airfoil profile substantially in accordance with pressure-side Cartesian coordinate values of X, Y, and Z set forth in the scalable identified herein as TABLE 1. The Cartesian coordinate values of X, Y, and Z are non-dimensional values convertible to dimensional distances by multiplying the Cartesian coordinate values of X, Y, and Z by a number. X and Y are coordinates which, when connected by smooth continuing arcs, define airfoil profile sections at each Z height. The airfoil profile sections at each Z height are joined smoothly with one another to form a complete pressure-side airfoil shape. The X, Y, and Z values are scalable as a function of the number to provide at least one of a non-scaled, scaled-up, and scaled-down airfoil.

The article of manufacture may be an airfoil or a stator vane configured for use with a compressor. The suction-side airfoil shape may lie in an envelope within +/−5% of a chord length in a direction normal to a suction-side airfoil surface location, or +/−0.25 inches in a direction normal to a suction-side airfoil surface location.

The number, used to convert the non-dimensional values to dimensional distances, may be a fraction, decimal fraction, integer, or mixed number. The height of the article of manufacture may be about 1 inch to about 30 inches, or any suitable height as desired in the specific application.

A compressor 2, according to an aspect of the present disclosure, may include a plurality of stator vanes 23. Each of the stator vanes 23 includes an airfoil 200 having a suction-side 310 airfoil shape, the airfoil 200 having a nominal profile substantially in accordance with suction-side 310 Cartesian coordinate values of X, Y, and Z set forth in a scalable table identified herein as TABLE 1. The Cartesian coordinate values of X, Y, and Z are non-dimensional values convertible to dimensional distances by multiplying the Cartesian coordinate values of X, Y, and Z by a number. The number, used to convert the non-dimensional values to dimensional distances, may be a fraction, decimal fraction, integer, or mixed number. X and Y are coordinates which, when connected by smooth continuing arcs, define airfoil profile sections at each Z height. The airfoil profile sections at each Z height are joined smoothly with one another to form a complete suction-side 310 airfoil shape.

The compressor 2, according to an aspect of the present disclosure, may also have a plurality of stator vanes 23 having a pressure-side 320 nominal airfoil profile substantially in accordance with pressure-side Cartesian coordinate values of X, Y, and Z set forth in scalable TABLE 1. The Cartesian coordinate values of X, Y, and Z are non-dimensional values convertible to dimensional distances by multiplying the Cartesian coordinate values of X, Y, and Z by a number. The number (which would be the same number used for the suction side) may be a fraction, decimal fraction, integer, or mixed number. X and Y are coordinates which, when connected by smooth continuing arcs, define airfoil profile sections at each Z height, the airfoil profile sections at each Z height being joined smoothly with one another to form a complete pressure-side airfoil shape.

An important term in this disclosure is profile. The profile is the range of the variation between measured points on an airfoil surface and the ideal position listed in scalable TABLE 1. The actual profile on a manufactured blade or vane may be different than those in scalable TABLE 1, and the design is robust to this variation ("robust" meaning that mechanical and aerodynamic function is not impaired). As noted above, an approximately + or −5% chord and/or 0.25 inch profile tolerance is used herein. The X, Y, and Z values are all non-dimensionalized.

The following are non-limiting examples of the airfoil profiles embodied by the present disclosure. On some compressors, each airfoil profile section (e.g., at each Z height) may be connected by substantially smooth continuing arcs. On other compressors, some of the airfoil profile sections may be connected by substantially smooth continuing arcs. Embodiments of the present disclosure may also be employed by a compressor having stage(s) with no airfoil profile sections connected by substantially smooth continuing arcs.

The disclosed airfoil shape increases reliability and is specific to the machine conditions and specifications. The airfoil shape provides a unique profile to achieve (1) interaction between other stages in the compressor; (2) aerodynamic efficiency; and (3) normalized aerodynamic and mechanical blade or vane loadings. The disclosed loci of points allow the gas turbine and compressor or any other suitable turbine/compressor to run in an efficient, safe, and smooth manner. As also noted, any scale of the disclosed airfoil may be adopted as long as (1) interaction between other stages in the compressor; (2) aerodynamic efficiency; and (3) normalized aerodynamic and mechanical blade loadings are maintained in the scaled compressor.

The airfoil 200 described herein thus improves overall compressor 2 efficiency. Specifically, the airfoil 200 provides the desired turbine/compressor efficiency lapse rate (ISO, hot, cold, part-load, etc.). The airfoil 200 also meets all requirements for aeromechanics, loading, and stress.

It should be understood that the finished article of manufacture, blade, or vane does not necessarily include all the sections defined in the one or more tables listed above. The portion of the airfoil proximal to a platform (or dovetail) and/or tip may not be defined by an airfoil profile section. It should be considered that the airfoil proximal to the platform or tip may vary due to several imposed constraints. The airfoil contains a main profile section that is substantially defined between the inner and outer flowpath walls. The remaining sections of the airfoil may be partly, at least partly, or completely located outside of the flowpath. At least some of these remaining sections may be employed to improve the curve fitting of the airfoil at its radially inner or outer portions. The skilled reader will appreciate that a suitable fillet radius may be applied between the platform and the airfoil portion of the article of manufacture, blade, or vane.

This written description uses examples to disclose the presently claimed subject matter, including the best mode, and also to enable any person skilled in the art to practice the claimed subject matter, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An article of manufacture comprising a nominal airfoil profile in accordance with Cartesian coordinate values of X, Y, and Z set forth in a scalable table identified as TABLE 1, wherein the Cartesian coordinate values of X, Y, and Z are non-dimensional values convertible to dimensional distances by multiplying the Cartesian coordinate values of X, Y, and Z by a number; and wherein the X and Y values are coordinates which, when connected by continuing arcs, define airfoil profile sections at each Z height, the airfoil profile sections at each Z height being joined smoothly with one another to form a complete airfoil shape.

2. The article of manufacture according to claim 1, wherein the article of manufacture comprises an airfoil.

3. The article of manufacture according to claim 1, wherein the article of manufacture comprises a stator vane configured for use with a compressor.

4. The article of manufacture according to claim 1, wherein the airfoil shape lies in an envelope within at least one of: +/−5% of a chord length in a direction normal to an airfoil surface location; and +/−0.25 inches in a direction normal to an airfoil surface location.

5. The article of manufacture according to claim 1, wherein the number, used to convert the non-dimensional values to dimensional distances, is at least one of a fraction, a decimal fraction, an integer, and a mixed number.

6. The article of manufacture according to claim 1, wherein a height of the article of manufacture is about 1 inch to about 30 inches.

7. An article of manufacture comprising a suction-side nominal airfoil profile in accordance with suction-side Cartesian coordinate values of X, Y, and Z set forth in a scalable table identified as TABLE 1, wherein the Cartesian coordinate values of X, Y, and Z are non-dimensional values convertible to dimensional distances by multiplying the Cartesian coordinate values of X, Y, and Z by a number; and wherein the X and Y values are coordinates which, when connected by continuing arcs, define suction-side airfoil profile sections at each Z height, the suction-side airfoil profile sections at each Z height being joined smoothly with one another to form a complete suction-side airfoil shape, the X, Y, and Z coordinate values being scalable as a function of the number to provide at least one of a non-scaled, scaled-up, and scaled-down airfoil profile.

8. The article of manufacture according to claim 7, wherein the article of manufacture comprises an airfoil.

9. The article of manufacture according to claim 7, wherein the article of manufacture comprises a stator vane configured for use with a compressor.

10. The article of manufacture according to claim 7, wherein the suction-side airfoil shape lies in an envelope within at least one of: +/−5% of a chord length in a direction normal to a suction-side airfoil surface location; and +/−0.25 inches in a direction normal to a suction-side airfoil surface location.

11. The article of manufacture according to claim 7, wherein the number, used to convert the non-dimensional values to dimensional distances, is at least one of a fraction, a decimal fraction, an integer, and a mixed number.

12. The article of manufacture according to claim 7, wherein a height of the article of manufacture is about 1 inch to about 30 inches.

13. The article of manufacture according to claim 7, further comprising the article of manufacture having a pressure-side nominal airfoil profile in accordance with pressure-side Cartesian coordinate values of X, Y, and Z set forth in the scalable table, wherein the Cartesian coordinate values of X, Y, and Z are non-dimensional values convertible to dimensional distances by multiplying the Cartesian coordinate values of X, Y and Z by the number; and wherein the X and Y values are coordinates which, when connected by continuing arcs, define pressure-side airfoil profile sections at each Z height, the pressure-side airfoil profile sections at each Z height being joined smoothly with one another to form a complete pressure-side airfoil shape, the X, Y and Z coordinate values being scalable as a function of the number to provide at least one of a non-scaled, scaled-up, and scaled-down airfoil.

14. A compressor comprising a plurality of stator vanes, each of the stator vanes including an airfoil having a suction-side airfoil shape, the airfoil having a nominal profile in accordance with suction-side Cartesian coordinate values of X, Y, and Z set forth in a scalable table identified as TABLE 1, wherein the Cartesian coordinate values of X, Y, and Z are non-dimensional values convertible to dimensional distances by multiplying the Cartesian coordinate values of X, Y, and Z by a number; and wherein the X and Y values are coordinates which, when connected by continuing arcs, define suction-side airfoil profile sections at each Z height, the suction-side airfoil profile sections at each Z height being joined smoothly with one another to form a complete suction-side airfoil shape.

15. The compressor according to claim 14, wherein the suction-side airfoil shape lies in an envelope within at least one of: +/−5% of a chord length in a direction normal to a suction-side airfoil surface location; and +/−0.25 inches in a direction normal to a suction-side airfoil surface location.

16. The compressor according to claim 14, wherein the number, used to convert the non-dimensional values to dimensional distances, is at least one of a fraction, a decimal fraction, an integer, and a mixed number.

17. The compressor according to claim 14, wherein a height of each stator vane is about 1 inch to about 30 inches.

18. The compressor according to claim 14, further comprising each of the plurality of stator vanes having a pressure-side nominal airfoil profile in accordance with pressure-side Cartesian coordinate values of X, Y, and Z set forth in the scalable table, wherein the Cartesian coordinate values of X, Y, and Z are non-dimensional values convertible to dimensional distances by multiplying the Cartesian coordinate values of X, Y, and Z by the number; and wherein the X and Y values are coordinates which, when connected by continuing arcs, define pressure-side airfoil profile sections at each Z height, the pressure-side airfoil profile sections at each Z height being joined smoothly with one another to form a complete pressure-side airfoil shape.

19. The compressor according to claim 18, wherein the pressure-side airfoil shape lies in an envelope within at least one of: +/−5% of a chord length in a direction normal to a pressure-side airfoil surface location; and +/−0.25 inches in a direction normal to a pressure-side airfoil surface location.

20. The compressor according to claim 18, wherein the number, used to convert the non-dimensional values to dimensional distances, is at least one of a fraction, a decimal fraction, an integer, and a mixed number.

* * * * *